US006003203A

United States Patent [19]

Fowlston

[11] Patent Number: 6,003,203

[45] Date of Patent: Dec. 21, 1999

[54] HINGE FOR CONNECTING A LID TO A BOX

[76] Inventor: Kenneth B. Fowlston, 61 Rossburn Drive, Etobicoke, Ontario, Canada, M9G 2P9

[21] Appl. No.: 08/880,161

[22] Filed: Jun. 24, 1997

[51] Int. Cl.[6] ..... E05D 1/00

[52] U.S. Cl. ..... 16/225; 16/382; 16/DIG. 13

[58] Field of Search ..... 16/225, DIG. 13, 16/252, 382, 384, 388; 403/119

[56] References Cited

U.S. PATENT DOCUMENTS

| | | | |
|---|---|---|---|
| 3,527,283 | 9/1970 | Butler et al. | 16/225 |
| 4,296,524 | 10/1981 | Horholt et al. | 16/225 |
| 4,557,064 | 12/1985 | Thompson | 40/10 R |
| 4,670,938 | 6/1987 | Fowlston | 16/225 |
| 5,513,909 | 5/1996 | Teich | 16/383 |
| 5,539,955 | 7/1996 | Wiese | 16/225 |
| 5,588,181 | 12/1996 | Sutton | 16/382 |
| 5,729,867 | 3/1998 | Carmichael | 16/225 |

*Primary Examiner*—Chuck Y. Mah
*Attorney, Agent, or Firm*—Eugene J. A. Gierczak

[57] ABSTRACT

A hinge for connecting a lid to a box which includes a flexible web, a pinching means for securing the hinges to a panel of a box and a mounting means for affixing adhesively a lid to the hinge.

10 Claims, 5 Drawing Sheets

HINGE FOR CONNECTING A LID TO A BOX

FIELD OF THE INVENTION

This invention relates to hinges for connecting a panel to a box and particularly relates to a hinge for connecting a top to an open cardboard box.

BACKGROUND OF INVENTION

Containers with lids are commonly used in food shops to store and display bulk foods. These containers may be made from a variety of material such as plastic and the like. Flexible plastic hinges for connecting a lid to a panel of such a plastic container are well-known. Reference is made to U.S. Pat. No. 4,670.938 which discloses a hinge having ribs at each end that are received by a first groove located on a first panel of a plastic box and a second groove located on a plastic lid.

Furthermore, a variety of hinged joints have heretofore been designed for effecting a hinged connection between panels such as that shown in U.S. Pat. No. 5,539,955.

Some of these hinged joints include clamping mechanisms for clamping a panel portion such as that disclosed in U.S. Pat. No. 5,487,690, while U.S. Pat. No. 4,557,064 shows wall portions connected to provide an entrance for insertion of a display which portions include a plurality of plastic projections to grip the display card.

Lidded containers made of plastic are costly. In addition, bulk foods are generally delivered to food shops in cardboard containers, from which the bulk foods must be transferred to the boxes made of plastic to allow convenient storage and display.

It is an object of the present invention to provide a hinge for mounting a lid on a cardboard container, which hinge can also be adapted for mounting a lid on a container made of plastic. It is a further object of this invention to provide an efficient and inexpensive means of providing covers for boxes of all types, and in particular cardboard boxes.

The hinge disclosed herein can either be extruded from a plastic such as polypropylene, in the manner known to those skilled in the art, so as to define a web of the requisite thickness so as to allow flexibility of the hinge along said web. Alternatively, the hinge disclosed herein can be extruded from polyvinyl which is more resistant to a large number of flexure cycles than polypropylene by means of the co-extrusion process disclosed in U.S. Pat. No. 4,563,381 so as to define two parts of a hinge made of rigid polyvinyl and an intermediate connecting web made of flexible polyvinyl. More particularly, the profile of the hinge is constructed of rigid polyvinyl chloride (PVC) plastic, with the web portion being of a clear flex PVC.

SUMMARY OF INVENTION

One aspect of the invention relates to a first panel of a box, a lid comprising a second panel and a hinge for connecting the first panel and the second panel; the hinge comprising a flexible web, clamping members defining a pinching means for pinching the first panel, and a mounting means for affixing adhesively the second panel to the hinge.

Another aspect of the invention resides in connecting a lid to a cardboard box; but means are also disclosed for connecting a lid to a box made of non-deformable material such as acrylic or the like.

DESCRIPTION OF DRAWINGS

FIG. 6 is a perspective view of another embodiment of the invention; while

FIG. 7 is a perspective view of the hinge secured to a non-deformable material by means of an anchor bar; while

DETAILED DESCRIPTION OF THE INVENTION

The parts have been given likes numbers throughout the Figures.

Figure 1:
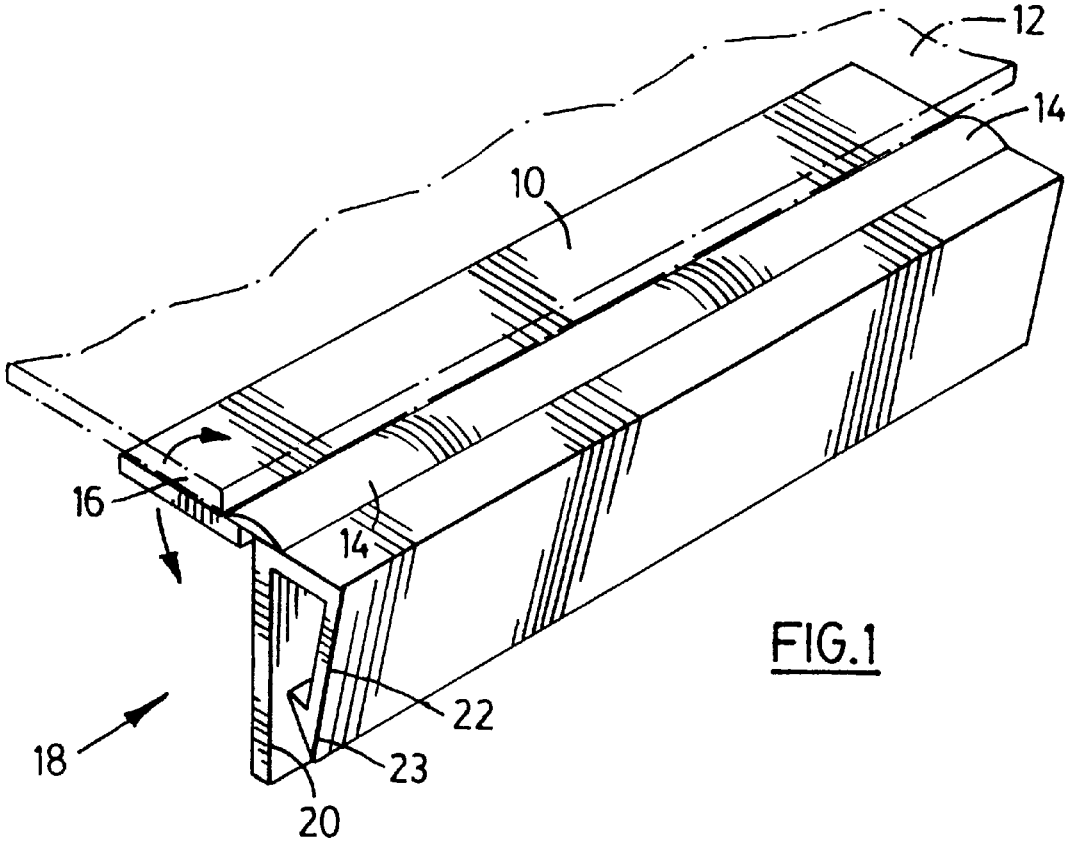
FIG. 1 is a perspective view of the hinge.
Figure 2:
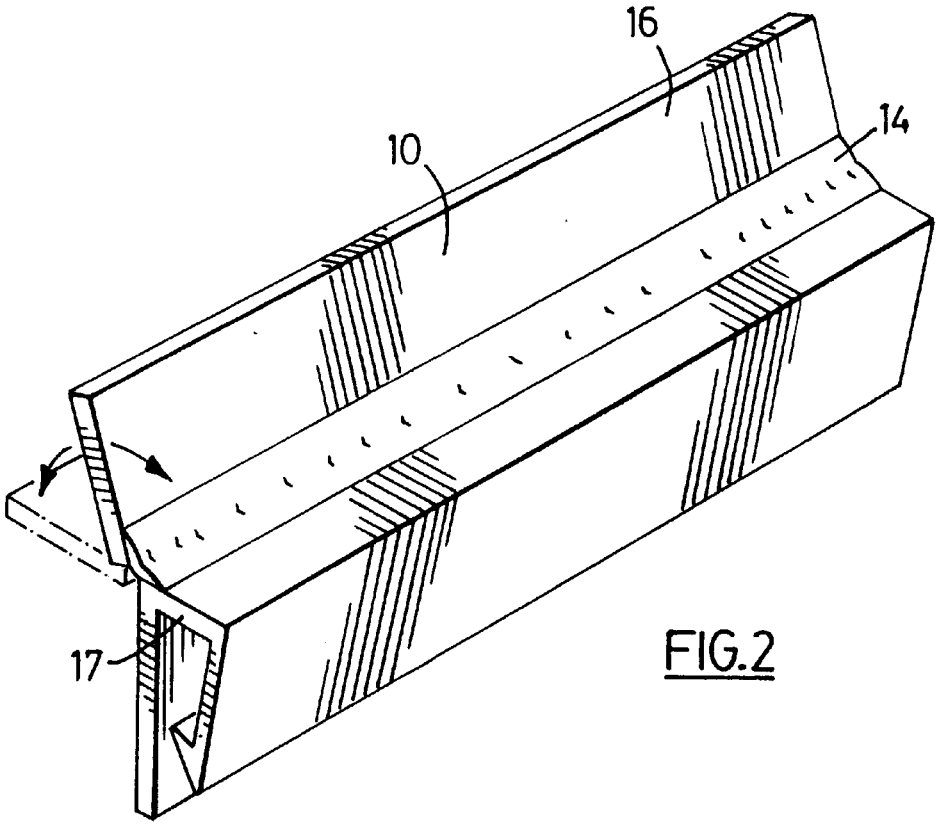
FIG. 2 is a perspective view of the hinge, as shown in FIG. 1, showing the rotational displacement of the mounting means along the flexible web.
Figure 4:
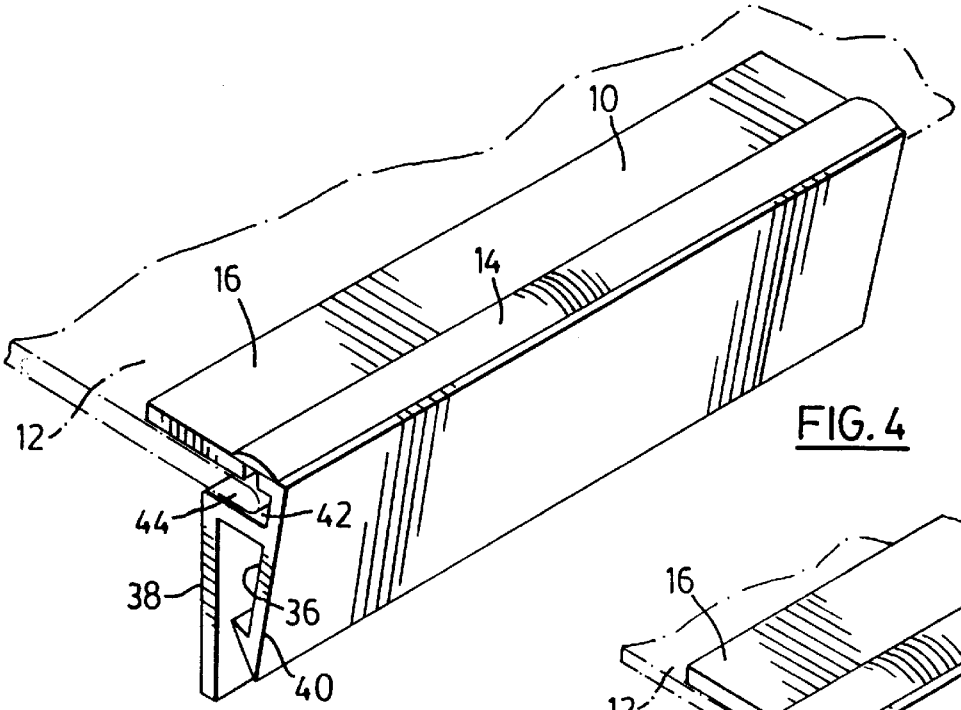
FIG. 4 and FIG. 4*a* are perspective views of a second embodiment of the invention.
Figure 4A:
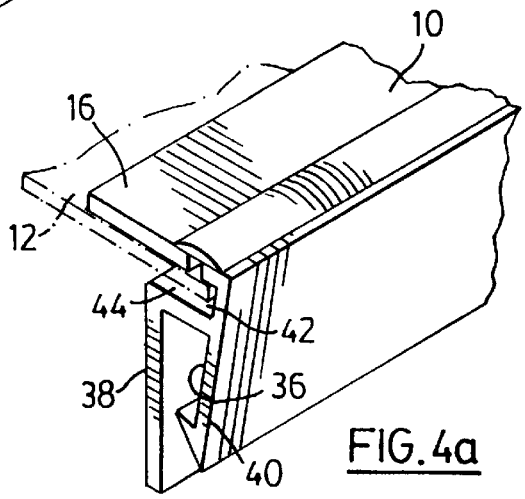
Figure 5:
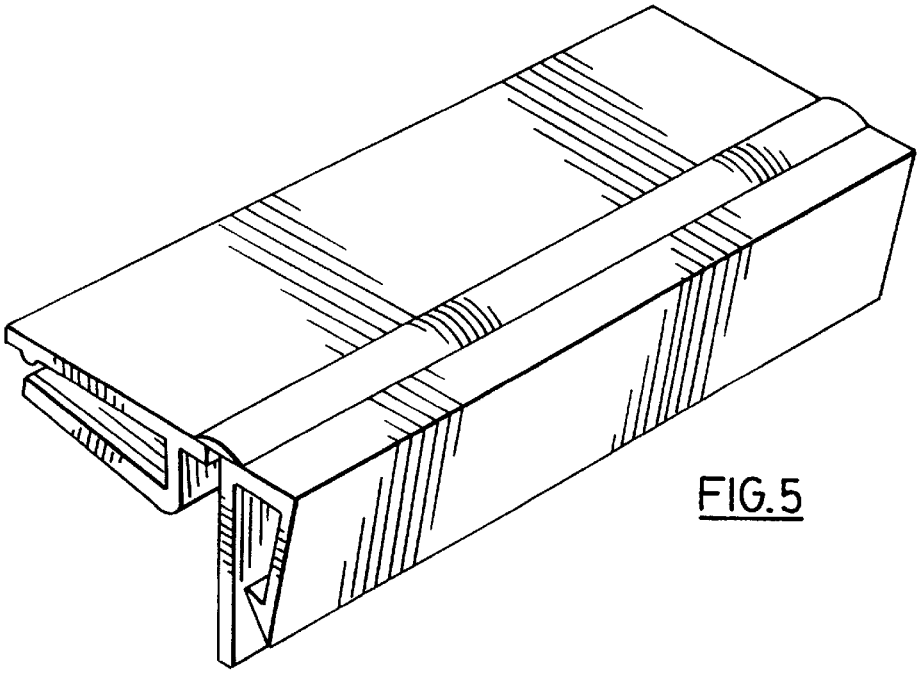
FIG. 5 is a perspective view of another embodiment of the invention.

The embodiment shown in FIG. 1 and FIG. 2 consists of a hinge 10 to which a panel 12 is adhesively affixed. The hinge 10 comprises a flexible web 14, a mounting means 16 to which the panel 12 is adhesively attached, and a pinching means 18. The pinching means 18 consists of a first clamping member 20 and a second clamping member 22. A barb or fixing structure 23 is located at the extremity of the second clamping member 22. The panel 12 may be adhesively attached to the top of the mounting means as shown in FIG. 1 or on the bottom surface of the mounting means as shown in FIG. 4.

FIG. 2 shows the embodiment in FIG. 1 and illustrates the flexibility of the flexible web 14. Whether the disclosed hinge 10 is constructed of rigid PVC with a flexible web made of flexible PVC, or polypropylene, or the flexible web is of a thickness that permits flexibility, the invention will permit axial or rotational displacement of the mounting means 16 around the flexible web 14. On one embodiment the rigid PVC construction may be co-extruded with a flexible PVC making up the web 14. Alternatively, the hinge may be injection moulded in plastic material.

Figure 3A:
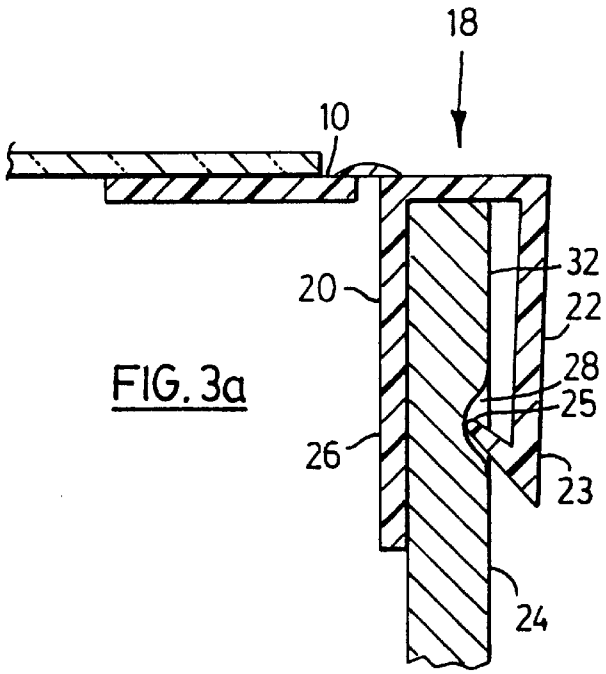
FIG. 3*a* is a cross-sectional view of the hinge deformably secured to a cardboard panel.

FIG. 3*a* shows a cross-sectional view of the hinge 10 shown in FIG. 1 and 2 in which the hinge 10 has been mounted on a panel of a cardboard box 24. The distance between the extremity of the barb 25 and the point on the first clamping member 26 that is closest to the barb 23 is selected to be shorter than the thickness of the cardboard panel 24 to be pinched by the pinching means 18, but still allowing the cardboard panel 24 to be inserted into the pinching means 18 by exertion of manual pressure.

As clamping members 20 and 22 are forced apart by inserting cardboard panel 24 said cardboard panel 24 is deformed at pressure point defined by points 25 and 26. Since cardboard is resilient to deformation, once cardboard panel 24 is pushed past pressure point 28, the cardboard panel will expand so that deformation 28 is substantially repleted by this expansion. The presence of deformation 28 on cardboard panel 24 makes removal of the cardboard panel 24 difficult because the expanded portion 32 of cardboard panel 24 needs to be deformed again for the panel 24 to be removed from the pinching means 18. In other words the barb 23 bites into the cardboard box, particularly if one attempts to remove the hinge. The barb 23 is comprised of rigid material.

If the pressure applied to cardboard passes a certain measurable threshold, the cardboard is crushed rather than deformed. When cardboard is crushed its ability to expand upon release of pressure is reduced if not eliminated. The use of one barb 23 in the invention, without use of a second barb on the first clamping member 20 reduces the likelihood that cardboard panel 24 will be crushed rather than deformed when inserted in the pinching means 18.

Figure 3:
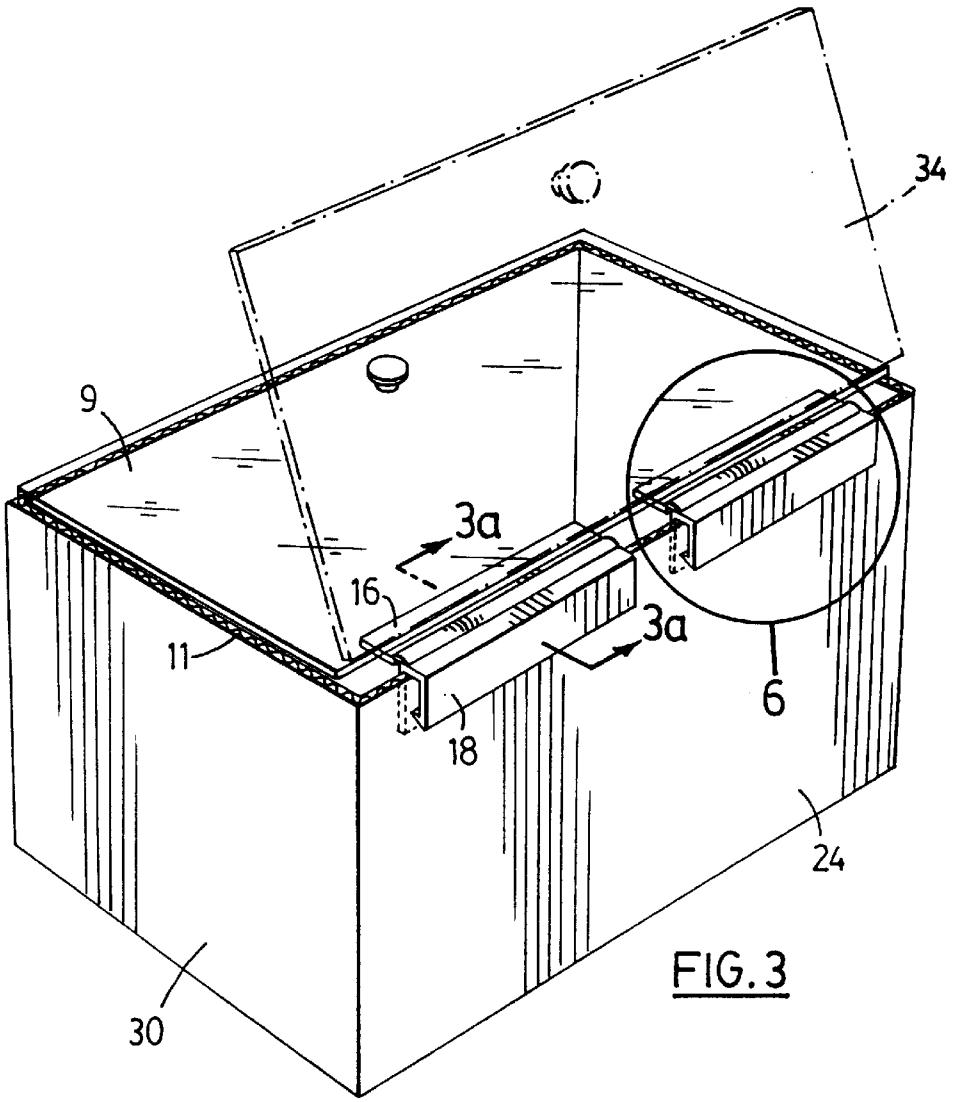
FIG. 3 is a perspective view of a cardboard box having a transparent plastic lid attached thereto by means of the invention.

The cardboard box illustrated in FIG. 3 shows a box 30 having an opening 9 defined by a perimetral rectangular lip 11. In the embodiment shown in FIG. 3, the top flaps of the box have been cut off, although the top flaps could also be folded back. In this regard, the opening between the clamping members 20 and 22 accommodate both boxes.

FIG. 3 shows a box 30 to which a lid 34 has been attached by means of the disclosed invention. The lid 34 has been adhesively attached to mounting means 16 and the pinching means 18 has been mounted on cardboard panel 24 by means of deformably securing the cardboard panel 24 by pinching means 18. The adhesive can consist of a double-sided tape or other appropriate adhesive such as glue, screws, rivets, sonic welding or the like.

FIG. 4 shows another embodiment of the invention consisting of a hinge 10 to which a panel 12 is adhesively affixed. The hinge 10 also comprises a flexible web 14, a mounting means 16 to which the panel 12 is adhesively attached, and a pinching means 36. Pinching means 36 is comprised of a first substantially straight leg 38, a second leg 40 spaced from first leg 38 at an angle relative to said first leg 38, and a connecting member 42 between the first leg 38 and second leg 40. Second leg 40 extends upwards beyond connecting member 42 so as to define a slot 44 for receiving panel 12.

The width of slot 44 is selected so that when the lid 34 is inserted into the slot 44 there is sufficient space between the lid 34 and connecting member 42 to permit rotation of the lid 34 about the flexible web 14. Alternatively, the width of the slot 44 is selected to frictionally engage panel 12 and strengthen the attachment of panel 12 to the hinge 10, in which event the end of the panel 12 is rounded to permit rotation about flexible web 14.

Figure 6:
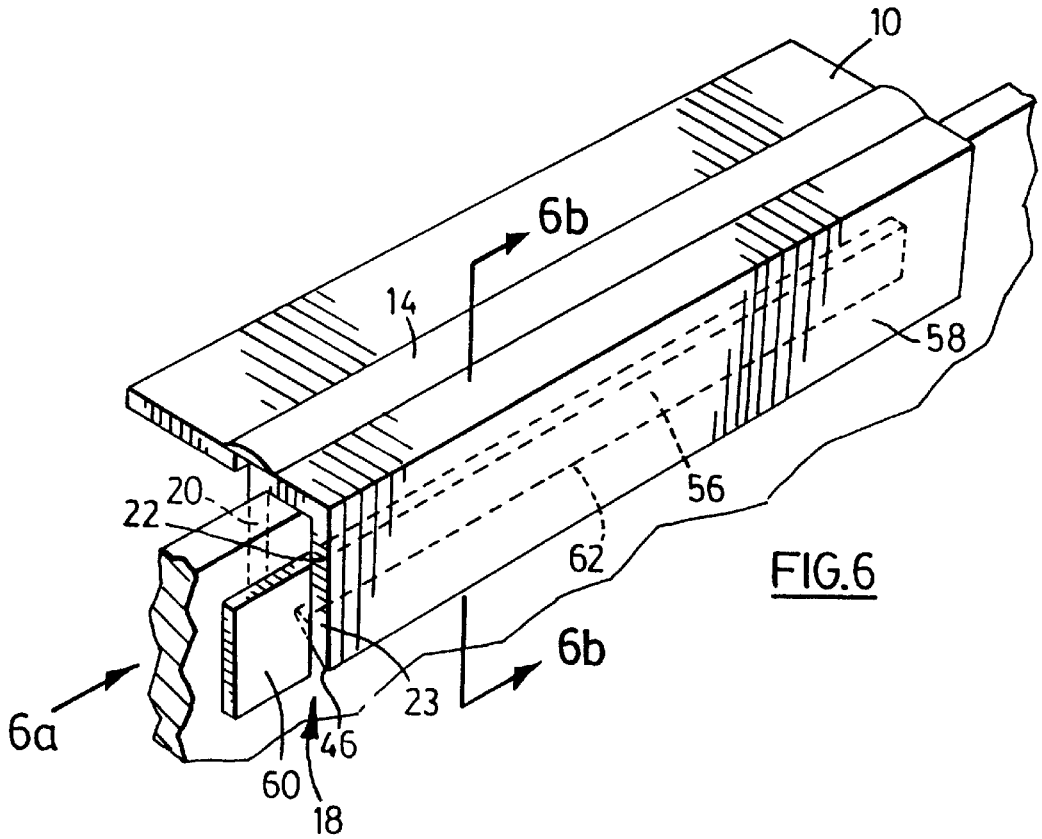

FIG. 6 shows an alternate embodiment of the invention having a modified mounting means 16 which comprises a means for securing panel 12.

Although the invention described herein is primarily intended for connecting a lid to a cardboard box, the hinge is also adaptable for securing a lid to a box made of non-deformable material such as polymethyl-methacrylate.

Figure 7:
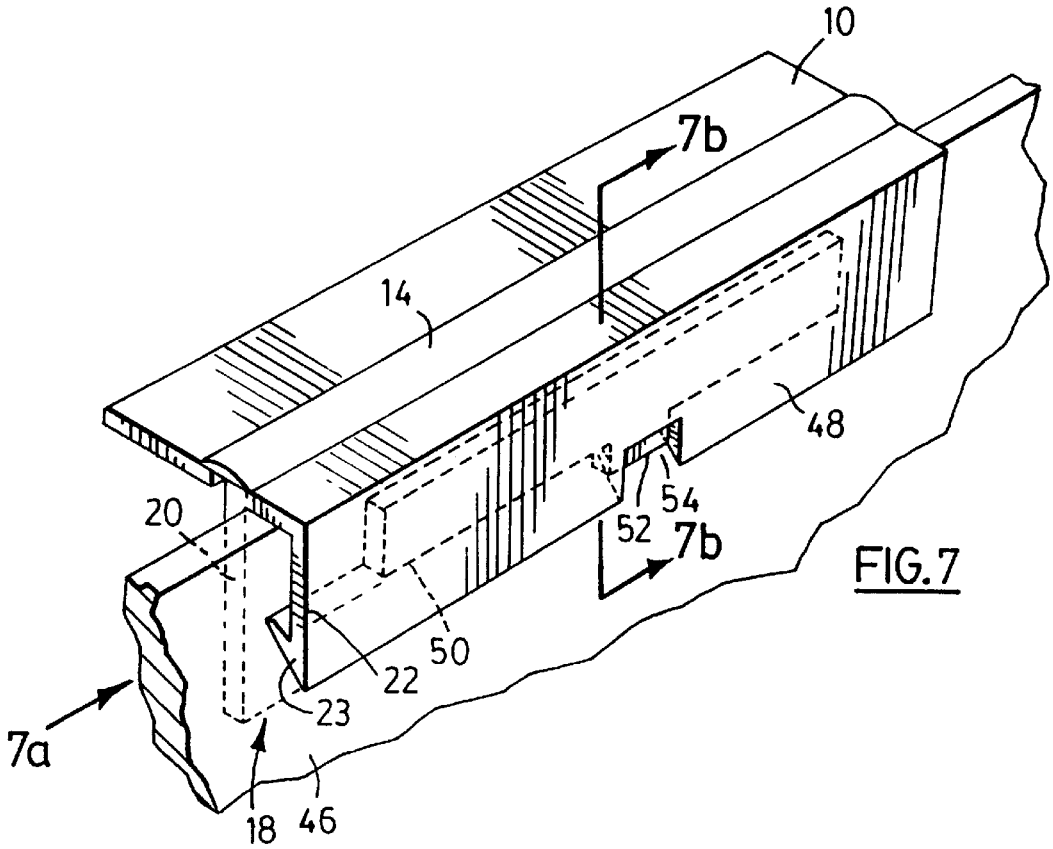
Figure 6A:
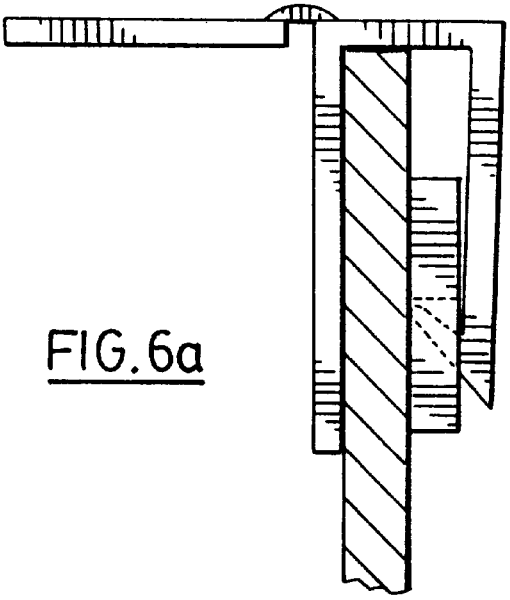
FIG. 6*a* and FIG. 6*b* illustrate cross-sectional views of FIG. 6.
Figure 6B:
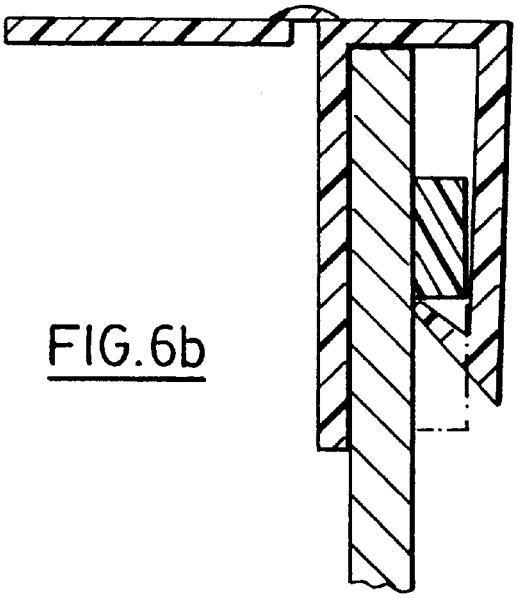
Figure 7A:
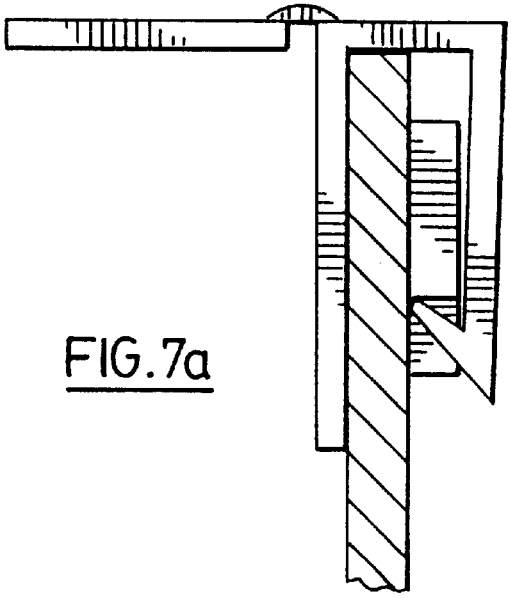
FIG. 7*a* and FIG. 7*b* illustrate cross-sectional views of FIG. 7.
Figure 7B:
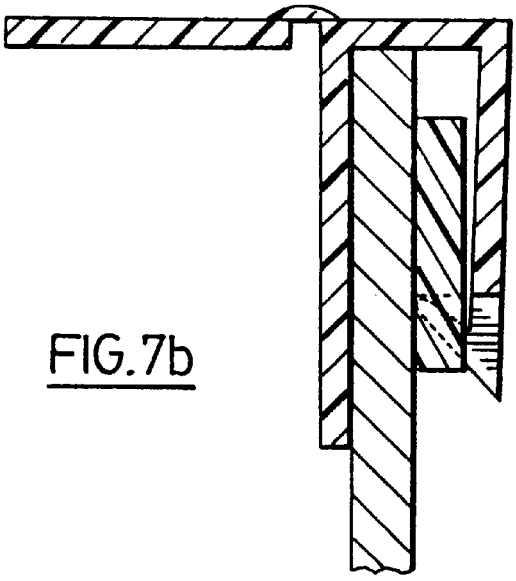

FIG. 7 shows the mounting of the hinge 10 on a panel of non-deformable material 46 by means of anchor bar 48. Anchor bar 48 is affixed adhesively to panel 46 so that barb 23 is engaged by the bottom of the anchor bar 50, and the distance between the first clamping member 20 and the second clamping member 22 is selectable to be shorter than the combined thickness of panel 46 and anchor bar 48, so that pinching means 18 is locked in place and cannot be easily lifted off panel 46. Lateral movement of the hinge 10 along the length of the anchor bar 48 is prevented by shoulder 52 on the anchor bar 48 which registers with gap 54 which is disposed on the hinge or leg 22 of the second clamping member 22.

FIG. 8 shows a construction of an anchor bar alternate to that depicted in FIG. 8, also adapted for mounting a panel of non-deformable material 46 on a hinge 10, namely side anchor bar 56. Side anchor bar 56 consists of narrow member 58 and broad end member 60. Side anchor bar 56 is affixed adhesively to panel 46 so that barb 23 is engaged by the bottom of narrow member 62, and the distance between the first clamping member 20 and the second clamping member 22 is selectable to be shorter than the combined thickness of panel 46 and anchor bar 48, so that pinching means 18 is locked in place and cannot be easily lifted off panel 46. Lateral movement of the hinge 10 along the length of the anchor bar 48 is prevented by broad end member 60, as one such side anchor bar 56 is affixed adhesively on panel 46 at each end of hinge 10, or at each end of panel 46.

It will be seen that the present invention attains several objects and advantages summarized above, including: enables a plastic hinge adapted to permit hinged connection of a lid to a cardboard box or, alternatively, a box made of non-deformable material; hence, provides alternatives to hinges adapted for use on boxes made of non-deformable material only; provides economical alternatives to more expensive hinged connections; provides for stable attachment of a hinge to a cardboard panel or a non-deformable panel by use of anchor bars.

It is to be understood that the above detailed description of preferred embodiments of the invention is provided by way of example only. Various details of design and construction may be modified without departing from the true spirit and scope of the invention, as set forth in the appended claims.

I claim:

1. A hinge for connecting a first panel to a second panel of a box comprising:

(a) a flexible web;

(b) first and second clamping members extending from said flexible web;

(c) pinching means extending from one of said members toward said other member for pinching said box between said members;

(d) mounting means extending from said flexible web for affixing adhesively said second panel to said hinge.

2. A hinge as described in claim 1, wherein the pinching means is a barb.

3. A hinge as described in claim 1, wherein the box is cardboard.

4. A hinge for connecting a first panel to a second panel of a box comprising:

(a) a flexible web;

(b) first and second clamping members extending from said flexible web;

(c) open pinching means extending from one of said members toward said other member for pinching said box between said members;

(d) mounting means extending from said flexible web for affixing adhesively second panel to said hinge.

5. A hinge as described in claim 4, wherein the pinching means is a barb.

6. A hinge as described in claim 4, wherein the box is cardboard.

7. A hinge for connecting a first panel to a second panel of a box comprising:

(a) a flexible web;

(b) first and second clamp legs extending from said flexible web;

(c) said first leg is flat and said second leg has a barb;

(d) said barb extending outwardly from said second leg toward said first leg;

(e) said legs and barb define a pinching means for pinching said box between said legs;

(f) mounting means extending from said flexible web for affixing adhesively said second panel to said hinge.

8. A hinge as described in claim 7, wherein the box is cardboard.

9. A hinge for connecting a first panel to a second panel of a box comprising:

(a) a first substantially straight leg;

(b) a second leg spaced from said first leg and disposed at an angle relative to said first leg, wherein said second leg is longer than said first leg;

(c) connecting member connecting said first leg to said second leg, said second leg defining an upper portion and a lower portion;

(d) a flexible web extending from said second leg;

(e) said connecting member and said upper portion defining a slot for receiving said second panel;

(f) mounting mens extending from said flexible web for affixing adhesively said second panel to said hinge.

10. A hinge as described in claim 9, wherein the box is cardboard.

* * * * *